United States Patent [19]

Nonami

[11] Patent Number: 5,016,864

[45] Date of Patent: May 21, 1991

[54] APPARATUS FOR FEEDING SHEET MATERIAL

[75] Inventor: Hidetaka Nonami, Tokyo, Japan

[73] Assignee: Kabushiki Kaisha Toshiba, Kawasaki, Japan

[21] Appl. No.: 420,517

[22] Filed: Oct. 12, 1989

[30] Foreign Application Priority Data

Oct. 31, 1988 [JP] Japan ..... 63-273041

[51] Int. Cl.[5] ..... B65H 1/18

[52] U.S. Cl. ..... 271/38

[58] Field of Search ..... 271/110, 164, 162, 37, 271/38, 117; 221/6, 17, 18

[56] References Cited

U.S. PATENT DOCUMENTS 4,553,831 11/1985 Dixon ..... 355/26
4,835,567 5/1989 Ogata ..... 271/164 X
4,892,299 1/1990 Hayama ..... 271/110

FOREIGN PATENT DOCUMENTS 207333 11/1984 Japan ..... 271/162
238633 10/1986 Japan ..... 271/110

*Primary Examiner*—David H. Bollinger
*Attorney, Agent, or Firm*—Foley & Lardner

[57] ABSTRACT

A copying machine including a cassette for storing a plurality of paper sheets P. The cassette is inserted into, or removed from, the copying machine through a front side. A paper-empty detecting unit detects the presence or the absence of paper sheets in the cassette. The paper-empty detecting unit comprises a detecting device and a moving device for moving the detecting device. The moving device moves the detecting device in response to the insertion or removal of the cassette. When the cassette is being inserted into or removed from the copying machine, the detecting device is moved out of the way by the moving device. After the cassette is inserted into the copying machine, the detecting device is moved to a detecting position at which the point of the detecting device abuts the paper sheet in the cassette. The detecting device is movable along the path of the fed paper sheet so that the detecting device fails to obstruct the paper sheet feeding notwithstanding the fact that the detecting device abuts the paper sheet.

12 Claims, 10 Drawing Sheets

APPARATUS FOR FEEDING SHEET MATERIAL

BACKGROUND OF THE INVENTION

This invention relates to an apparatus for feeding a sheet material, especially, an apparatus for feeding a sheet material from a container with a detecting mechanism for detecting an empty container.

U.S. Pat. No. 4,553,831 discloses a copying machine in which a front loading cassette is used. The copying machine with the front loading cassette is easily operated and needs less space than a copying machine with a side loading cassette. Such copying machine, however, fails to detect the paper-empty state of a cassette.

SUMMARY OF THE INVENTION

Accordingly, it is an object of the present invention to provide an apparatus for a front-loading cassette with a detecting mechanism for detecting an empty condition of the cassette.

In accordance with the present invention the foregoing object, among others, is achieved by providing an apparatus for feeding a sheet material comprising a housing. A storing means, removably inserted in the housing in along a first direction, stores a plurality of sheet materials. The sheet materials are fed by a feeding means along a second direction different from the first direction. Detecting means detect the presence of the sheet material in the storing means. The detecting means is moved by moving means so that the detecting means is deposited in a position removed from the path of movement of the storing means during insertion and removal of the storing means from the housing.

Other objects, features, and advantages of the present invention will become apparent form the following detailed description. It should be understood, however, that the detailed description and specific examples while indicating preferred embodiments of the invention, are given by way of illustration only, since various changes and modificatives within the spirit and scope of the invention will become apparent to those skilled in the art from this detailed description.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference characters designate the same or similar parts throughout the figures thereof and wherein.

DETAILED DESCRIPTION OF THE PREFERRED EMBODIMENTS

Figure 1:
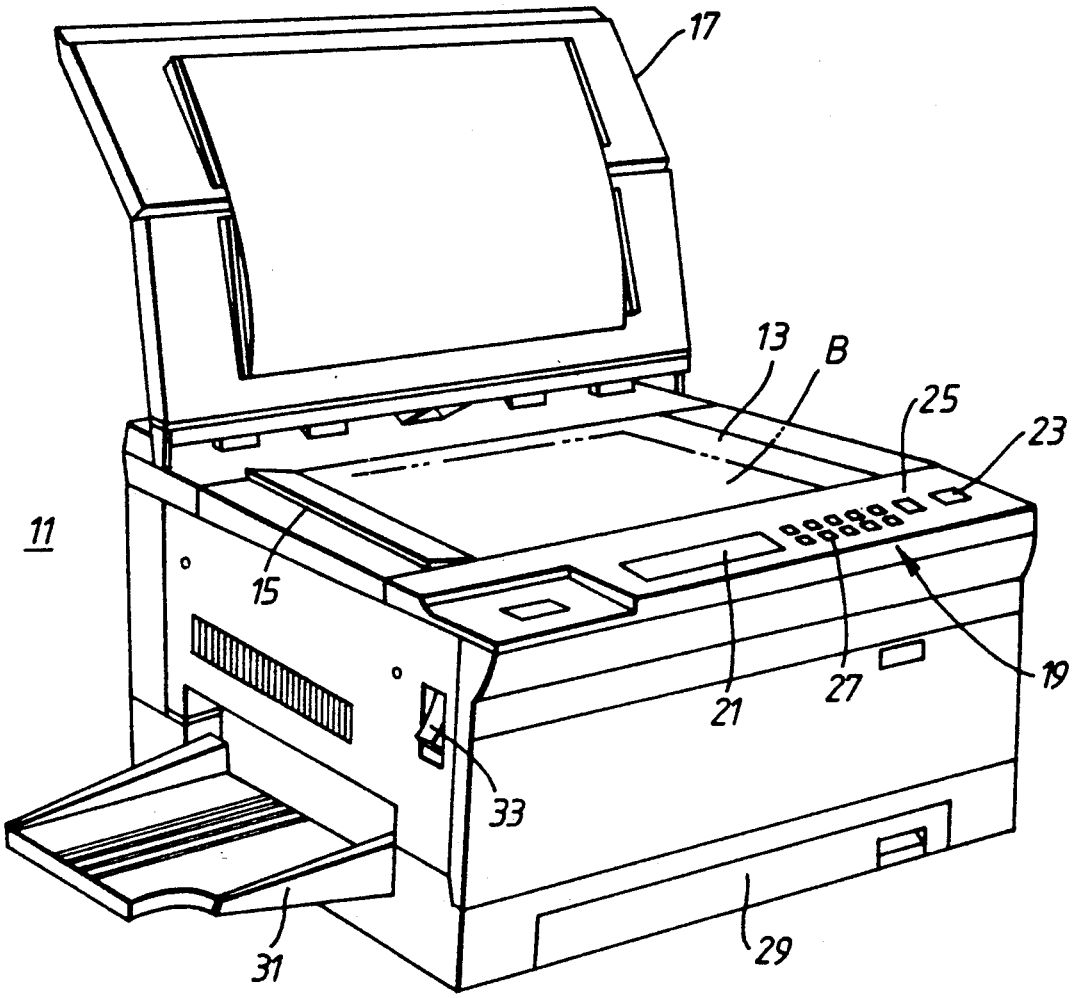
FIG. 1 is a perspective view of a copying machine according to the preferred embodiment of the present invention.

Referring now to FIG. 1, an image forming apparatus, such as a copying machine 11 includes a document table 13 on the upper surface of copying machine 11 for placement of an original document D to be copied. A setting scale 15, which is used as a reference for the documents D to be set on document table 13, is provided at the left-hand edge of document table 13. A document cover 17, which is permitted to be freely opened and closed toward document table 13, is provided on the upper surface of copying machine 11.

Copying machine 11 includes a control panel 19 at the front portion of the upper surface of copying machine 11. Control panel 19 incldes a plurality of keys and a display unit 21. A plurality of keys includes a copy key 23, a clear key 25 and digital keys 27. In response to the operation of copy bey 23, a copying operation is caused to start. The operation of clear key 23 puts the copying operation in a waiting mode. Information for the copying operation, e.g., the number of copies, is set by the operation of digital keys 27. Display unit 21 displays the information about the state of copying machine 11.

Storing means, such as a cassette 29 for storing a plurality of paper sheets P, is provided at the bottom of copying machine 11. Cassette 29 is permitted to be inserted into or removed from copying machine 11 through the front side of copying apparatus 11, thus saving space. A tray 31, which receives the copied paper sheet P, is provided at the side of copying machine 11. A power switch 33 is provided on the left-hand side of copying machine 11. In response to the operation of power switch 33, operating power for copying machine 11 is supplied.

Figure 2:
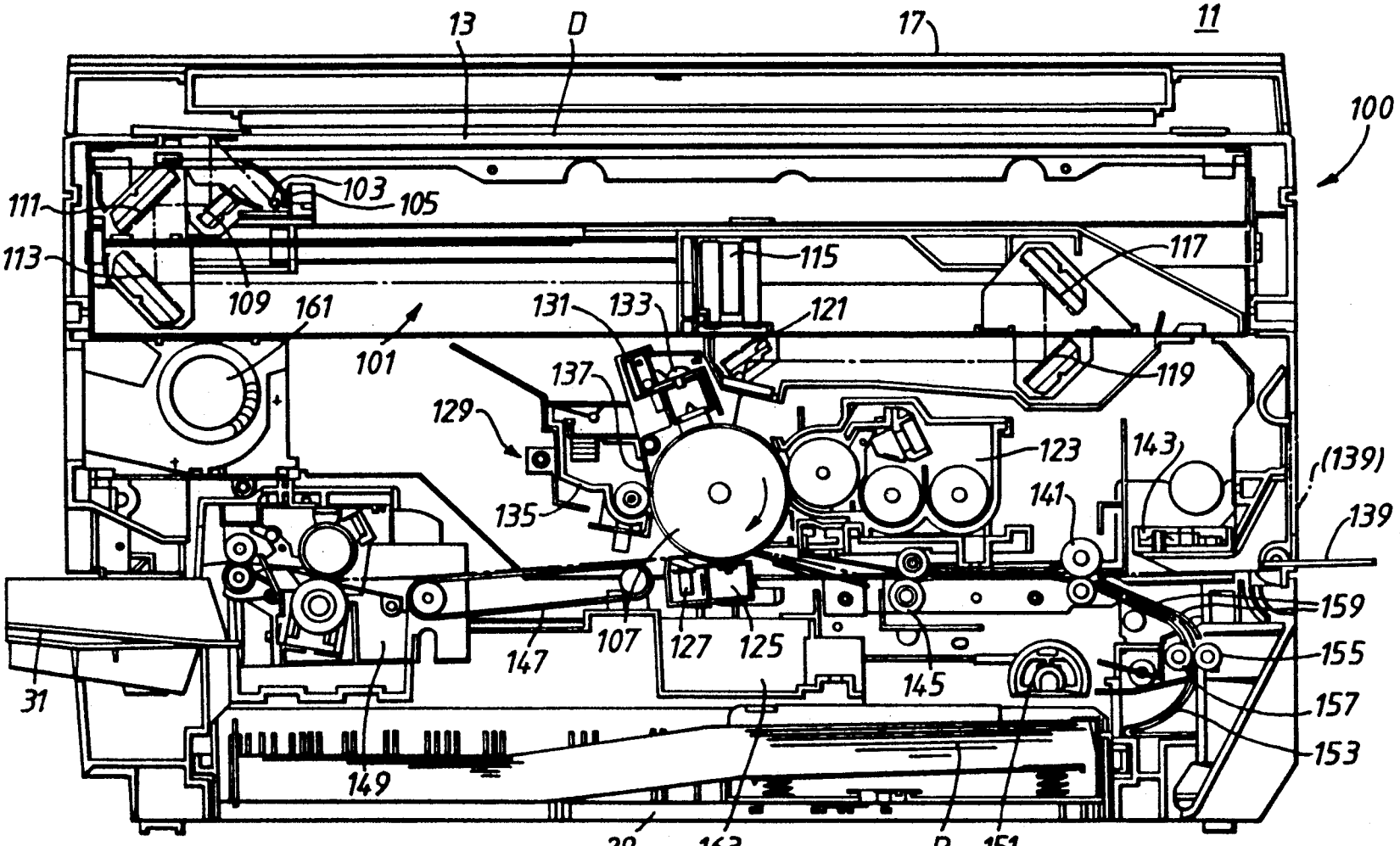
FIG. 2 is a sectional view of the copying machine shown in FIG. 1.

Referring now to FIG. 2, the details of copying machine 11 are as follows:

An optical system 101 for exposing and scanning of document D placed on document table 13 is provided below document table 13 in a housing 100 of copying machine 11. Optical system 101 includes an exposure lamp 103. Lamp 103 is surrounded at its rear portion by a reflector 105. A light emitted by lamp 103 is projected by reflector 105 to the surface of original document D placed on document table 13. Original document D placed on original document table 13 is scanned in incremental lines while being irradiated by lamp 103. The light reflected by original D is focused on the surface of a photosensitive drum 107 to form a latent image thereon, past first to third mirrors 109, 111 and 113, a lens 115, fourth to sixth mirrors 117, 119 and 121 in the order mentioned. Lamp 103 and first mirror 109 are mounted on a first carriage (not shown), and second and third mirrors 111 and 113 on a second carriage (not shown). During scanning of the original D, the first and second carriages move along table 13 reciprocally in synchronism with the rotation of photosensitive drum 107. In order to make constant the length of an optical path between original D and photosensitive drum 107, the second carriage reciprocates in the same direction as the first carriage at a speed one half that of the first carriage.

The latent image is made visible by a developer device 123. The developed image is transferred onto the paper sheet P by a transfer device 125. The paper sheet P with the developed image is separated from photosensitive drum 107 by a separation device 127. After the sheet is separated, a residual toner on the surface of photosensitive drum 107 is removed by a cleaner device 129. A discharging device 131 discharges the residual charge on the cleaned surface of photosensitive drum 107. The discharged photosensitive drum 107 is uniformly charged by a charging device 133. Adjacent to the position of the image focused bu optical unit 101 in the direction of photosensitive drum, rotation and about photosensitive drum 107 are developer device 123, transfer 125, separation device 127, cleaner device 129, discharging device 131 and charging device 133, in the order mentioned.

Developer device 123, of, which contains a first toner, is detachable from copying machine 11. The other developer device with a different kind of toner from the first toner, may be inserted. Developer device 123 includes a code (not shown) to indicate the king of toner. The code is read by sensor (not shown). The information corresponding to the code is sent to a controller (not shown) so that the detected kind of toner is displayed on display unit 21.

Cleaner device 129 includes a casing 135 and a cleaning blade 137 for scraping off the residual toner from the surface of photosensitive drum 107. The toner removed by cleaning blade 127 is transported by an auger (not shown) to a collecting box (not shown).

Discharging device 131 includes a discharging lamp for irradiating the entire surface of photosensitive drum 107 to place the entire surface at an uniform surface potential.

Copying apparatus 11 has two paper paths. One paper path is from cassette 29 through to tray 31. This paper path is referred to hereafter as a first paper path hereafter. The other paper path is from bypass-feed cover 139 through to tray 31. This paper path is referred to hereafter as a second paper path.

Bypass-feed cover 139 forms a portion of the side of copying machine 11. Opening bypass-feed cover 139 results in expose of an entrance for a manually fed paper sheet. When the entrance is exposed, a paper sheet P may be inserted manually into and between a pair of manual feed rollers 141 through a bypass guide 143. The inserted paper sheet P is detected by a manual feed switch (not shown). In response to the detection of the paper sheet P, a pair of manual feed rollers 141 are permitted to start rotating so that the inserted paper sheet P is fed to an aligning roller 145. Aligning roller 145 stops the inserted paper sheet P synchronously with the process of forming the image using photosensitive drum 107. Owing to aligning roller 145, the paper sheet P is correctly fed into a transferring position between photosensitive drum 107 and transfer device 125.

At the transferring position, a toner image is transferred onto the paper sheet P. The paper sheet P with the toner image is separated from photosensitive drum 107 through separation device 127. The separated paper sheet P is transported by a belt 147 to a fixing device 149. Fixing device 149 fixes the toner image onto the paper sheet by heat and pressure. The paper sheet P with the fixed image is then discharged onto tray 31. Tray 31 is the end of the second paper path.

The first paper path has a common portion with the second paper path. The common portion is from manual feed roller 141 through tray 31. The different portion of the first paper path from the second paper path is from cassette 29 through manual feed roller 141.

The paper sheet P in cassette 29 is fed by feeding means, such as a feed roller 151. Feed roller 151 is shaped like a half moon. If a horizontal plane of feed roller 151 faces cassette 29, feed roller 151 is apart from cassette 29 so that cassette 29 is permitted to be inserted into or removed from copying machine 11. When feed roller 151 is rotated a half revolution, then an arc surface of feed roller 151 comes in contact with a top paper sheet P in cassette 29 so that the top paper sheet P is fed out of cassette as feed roller 151 rotates.

The fed paper sheet P is guided by a guide plate 153 toward a pair of U-turn rollers 155 and 157. The right-hand U-turn roller 155 is made of a plastic material. The left-hand U-turn roller 157 is covered with rubber. A U-turn pathway 159 is provided from U-turn roller 155 through manual feed roller 141.

Left-hand U-turn roller 157 and manual-feed roller 141 are rotated synchronously with feed roller 151 so that the fed paper sheet P is fed further to aligning roller 145. As described above, the paper sheet P is transported along the same portion as that of the second paper path.

Copying machine 11 also includes other elements. For example, cooling fan 161 is positioned above fixing device 149. Cooling fan 161 exhausts the heated air inside copying machine 11 through a port 1 (not shown). Especially, fixing device 149 is cooled by cooling fan 161.

A high voltage transformer 163 is provided below transfer device 135 and separation device 137. High voltage transformer 163 supplies high voltage power to transfer device 125 and separation device 127.

Figure 3:
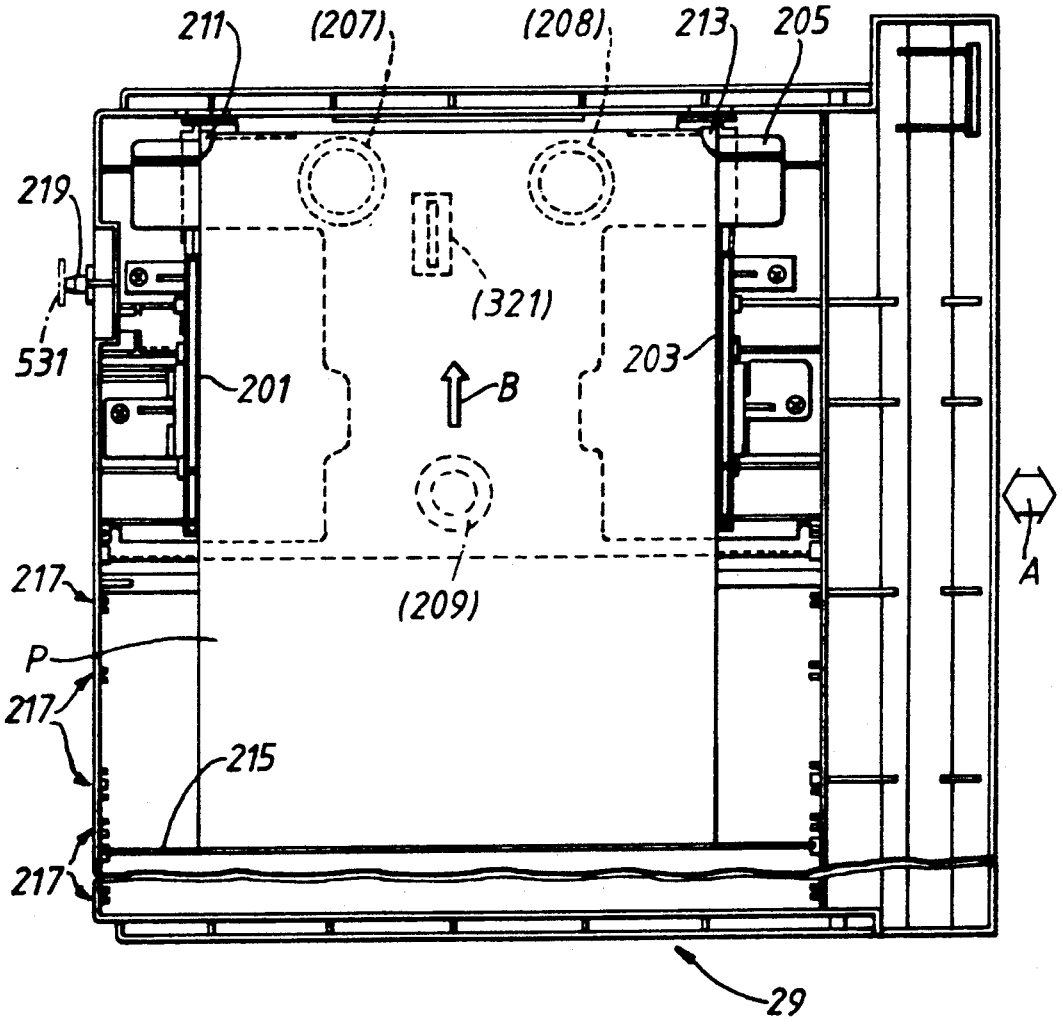
FIG. 3 is a plan view of a cassette used in the copying machine shown in FIG. 1.

Referring now to FIG. 3, cassette 29 includes a pair of side walls 201 and 203. A plurality of paper sheets P are inserted between a pair of side walls 201 and 203. Cassette 29 is inserted into or removed from copying machine 11 in the direction of the arrow A shown as FIG. 3. The inserted paper sheets P are fed from cassette 29 in the direction of the arrow B shown in FIG. 3. The directions indicated by the arrows A and B are perpendicular to each other. The side walls 201 and 203 are parallel to the direction indicated by the arrow B and perpendicular to the direction indicated by the arrow A.

Side walls 201 an 203 are slidable on the bottom of cassette 29 in order to adjust the width of the accommodated paper P. Between side walls 201 and 203 is provided a pushing plate 205 upon which a plurality of paper sheets P are positioned. Pushing plate 205 pushes up the paper sheet P by a plurality of springs, e.g., first, second, and third springs 207, 208, and 209 provided between pushing plate 205 and the bottom of cassette 29.

First and second springs are provided near the leading edge of the paper sheet P. Third spring 209 is provided near the center of the bottom of cassette 29. The force of third spring 209 is weaker than that of first and second springs 207 and 208. The force of first spring 207 is same as that of second spring 208. First, second, and third springs pushes plate 205 so that pushing plate 205 is inclined to the bottom of cassette 29. The leasing edge of the paper sheet P on plate 215 is at a higher position. The rear edge of the paper sheet P is at a lower position. With this configuration, the paper sheet P may be conveniently fed out of cassette 29.

The pushed-up paper sheet P is prevented from jumping out of cassette 29 by a pair of separating teeth 211 and 213. Separating teeth 211 and 213 hold down the leading edge of paper sheet P. At the rear edge of the paper sheet P is provided a back plate 215. Back plate 215 is detachably connected with cassette 29 through a plurality of guiding projections 217. A pair of guiding projections 217 are selected corresponding to the length of the paper sheet P. Between the selected pair of guiding projections, back plate 215 is inserted. The rear side of cassette 29 has a pin 219. Pin 219 is parallel to the inserting or removing direction of cassette 29, that is, the direction indicated by the arrow A shown in FIG. 3.

Figure 4:
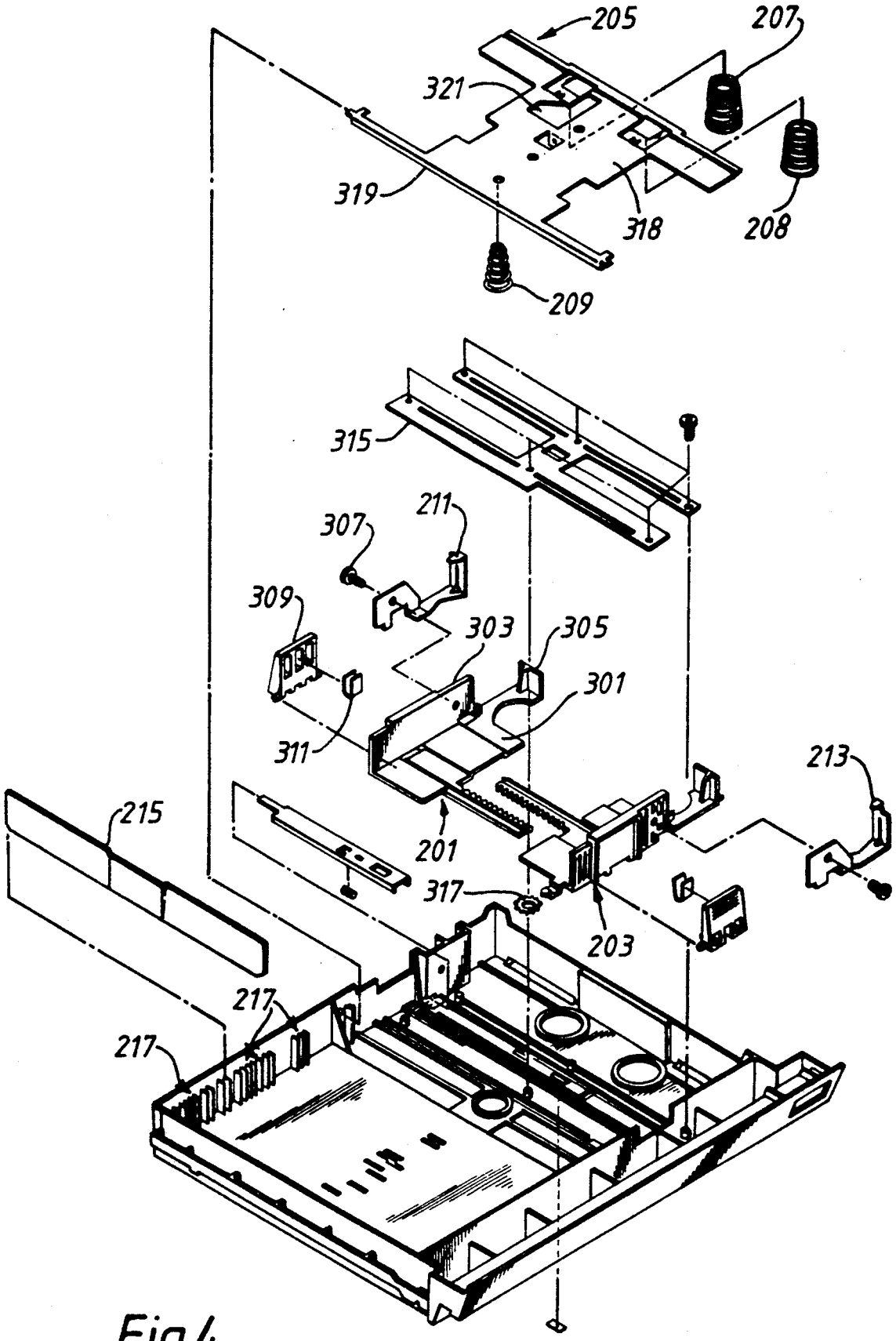
FIG. 4 is a exploded perspective view of the cassette shown in FIG. 3.

Referring now to FIG. 4 which is an exploded view of cassette 29, side wall 201 includes first, second, and third plates 301, 303, and 305, which are made in one body. First plate 301 has a long projection with tooth 211. Separating tooth 211 is fixed to first plate 301 by a bolt 307. The horizontal projecting portion of separating tooth 211 is in contact with third plate 305 when separating tooth 211 are fixed to first plate 301. This conjunction portion of separating tooth 211 and third plate 305 keeps in contact with the corner of the paper sheet P in cassette 29. A brake-arm 309 with a spring brake 311 is attached to first plate 301. The construction of side wall 203 is a reflected from that of side wall 201 except the position of the toothed long projection.

A pair of side walls 201 and 203 are positioned on supporting plate 315. Side walls 201 and 203 are slidable on supporting plate 315. The toothed long projections face each other through a gear 317. Gear 317 gears into each toothed long projection of first plates 301. Owing to the gear 317 and the toothed long projection, if one of side wall 201 or 203 is moved, the other side wall 203 or 201 is caused to move synchronously. First plate 301 of side wall 201 has the toothed long projection at a lower position. The toothed long projection is permitted to go under a portion of first plate 301 if side walls 201 and 203 approach so that the distance between side walls 201 and 203 may be small.

Pushing plate 205 includes a T-shaped portion 318 and a pivot portion 319. The width of T-shaped portion 318 is as almost same as the maximum interval between side walls 201 and 203 (See FIG. 3). Pivot portion 319 is hung over a pair of side walls 201 and 203. When pivot portion 319 is so hung over, the projecting portion of T-shaped portion 318 is positioned between second and third plates 303 and 305. As described above, pushing plate 205 is pushed up by first, second and third springs 205, 207, and 209. Between the position at which first and second springs 207 and 208 are attached to is provided a hole 321.

Figure 5:
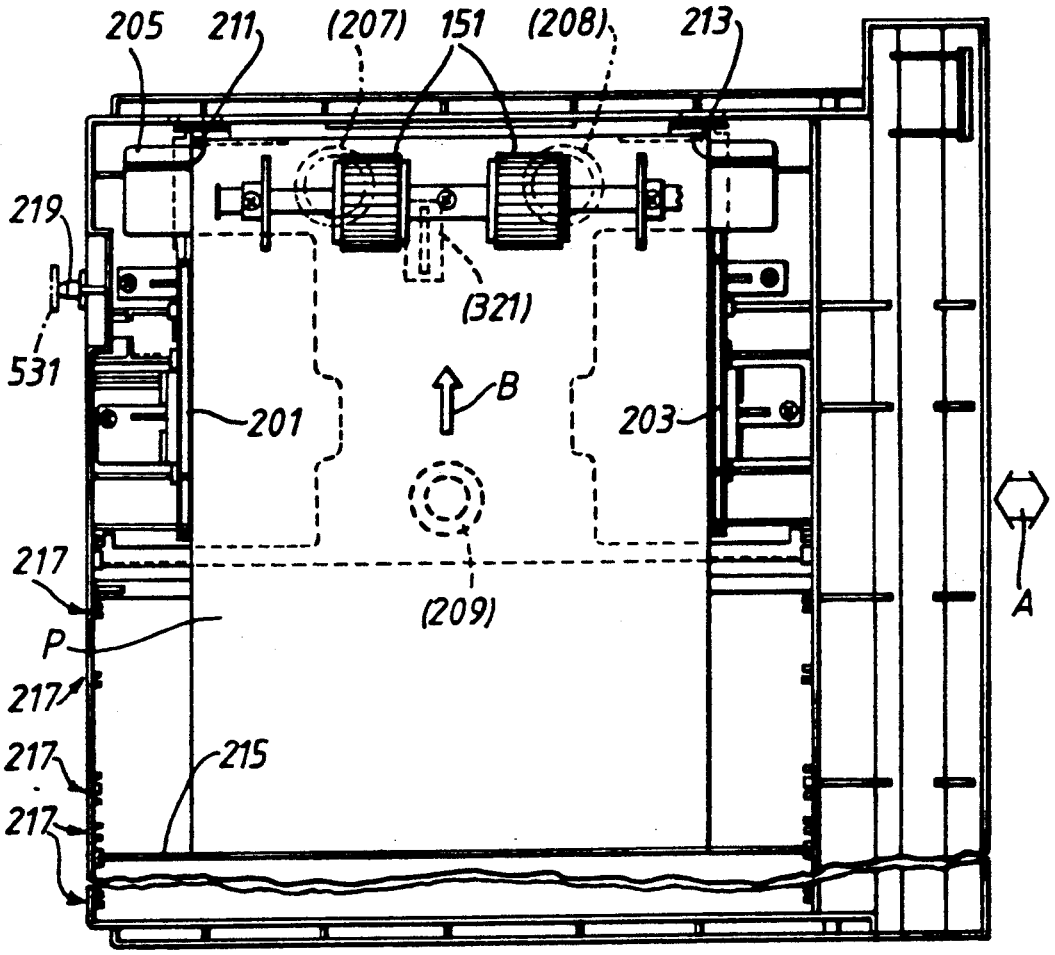
FIG. 5 is an illustrative plan view showing the operation of feeding a paper sheet from the cassette shown in FIG. 4.

Referring now to FIG. 5, the top paper sheet P in cassette 29 is fed by feed rollers 151. Separating claws 211 and 213 prevent a plurality of paper sheet P at when the paper sheet P is fed out of cassette 29.

A rotating axis has a pair of feed rollers 151. The position of feed rollers 151 is almost above first and second springs 207 and 209. Feed rollers are positioned away from hole 321 on pushing sheet 205 in order to permit detection of a paper empty condition.

Figure 6:
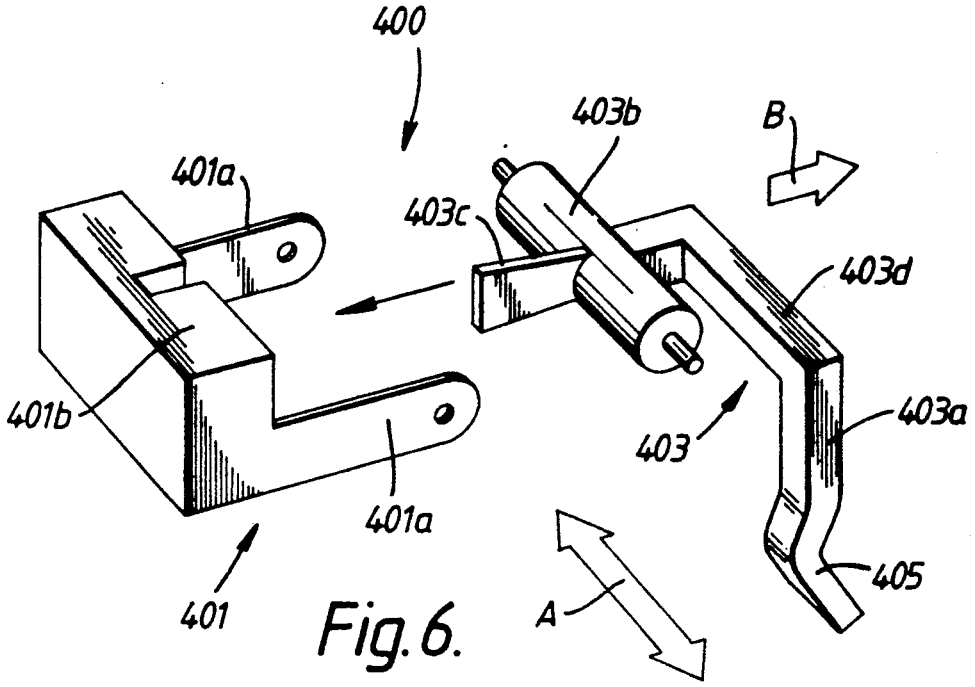
FIG. 6 is an exploded perspective view of a detecting device used in the copying machine shown in FIGS. 1 and 2.

Referring now to FIG. 6, the detection of the paper empty condition in cassette 29 will now be described.

Figure 7:
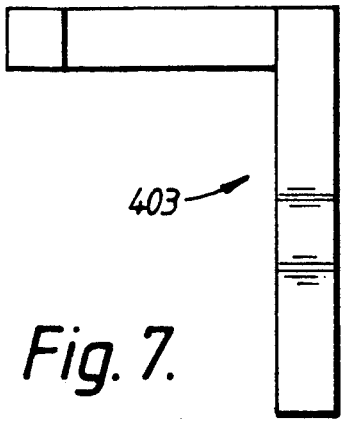
FIG. 7 is a view of a free arm of the detecting device shown in FIG. 6 in the direction of the arrow B in FIG. 6.
Figure 8:
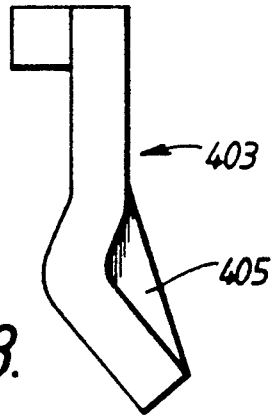
FIG. 8 is a view of the free arm of the detecting device shown in FIG. 6 in the direction of the arrow A in FIG. 6.
Figure 9:
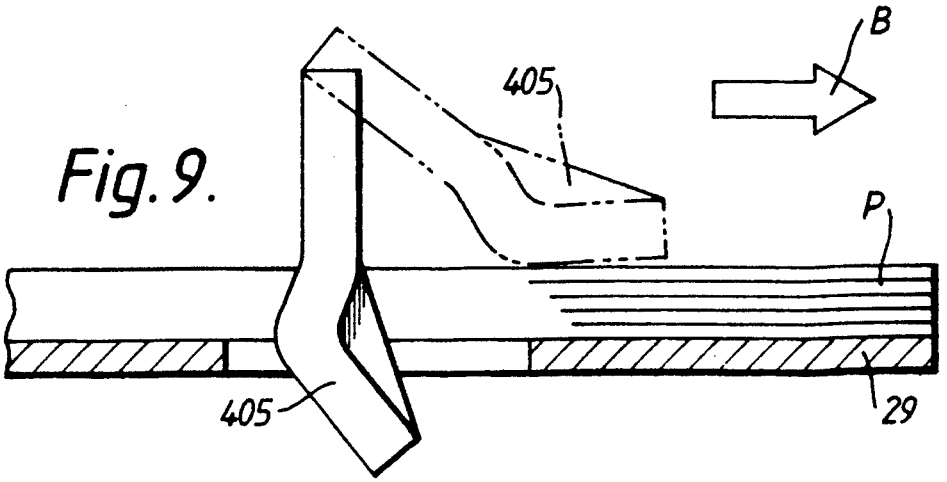
FIG. 9 is a sectional view showing the movement of the free arm of the detecting device shown in FIG. 6 shown in FIGS. 6, 7 and 8.

A paper-empty detection unit includes a moving unit 390 (FIG. 10) and detecting unit 400. Referring now to FIG. 6, the detecting unit 400 includes a detecting device 401 and a free arm 403. Free arm 403 includes an arm **403*a* and a detecting fin. The detecting fin is made of a rod 403*b* and an extending portion 403*c* perpendicular to the rotating axis of rod 403*b*. Free arm 403*a* is connected to the rotating axis of rod 403*b*. As shown in FIG. 7, free arm 403*a* is L-shaped when viewed in the direction of the arrow B in FIG. 6. As shown in FIG. 8, free arm 403*a* is hook-shaped when viewed in the direction of the arrow A in FIG. 6. A tip portion 405 of free arm 403*a* is arc-shaped. Free arm 403*a* may be hung directly from on rod 403*b* without a connecting portion 403*d***.

The rotating axis of free arm 403 along rod **403*b* is deposited through two holes of receiving portions 401*a*. Detecting device 401 includes a hatch 401*b* into which the extending portion 403*c* of the detecting fin is inserted. On both sides of hatch 401*b* are provided an emitting device (not shown) for emitting a light and a receiving device (not shown) for receiving the light emitted by the light emitting device. The light from the emitting device to the receiving device is interrupted by the extending portion 403*c*** of the fin.

In the cassette inserting state, the state of paper-empty is detected as follows:

If there are a plurality of paper sheets P in cassette 29, tip portion 405 butts against the top paper sheet P in cassette 29. Free arm 403 is inclined to detecting device 401 so that the receiving device of detecting device 401 is permitted to receive the light from the emitting device. If there is no paper sheet P in cassette 29, tip portion 405 drops into hole 321 in cassette 29 so that the extending portion **403*c* interrupts the light, so that the receiving device of detecting device 401** fails to receive the light from the emitting device. This change in light level means the state of the paper supply is empty.

Figure 10:
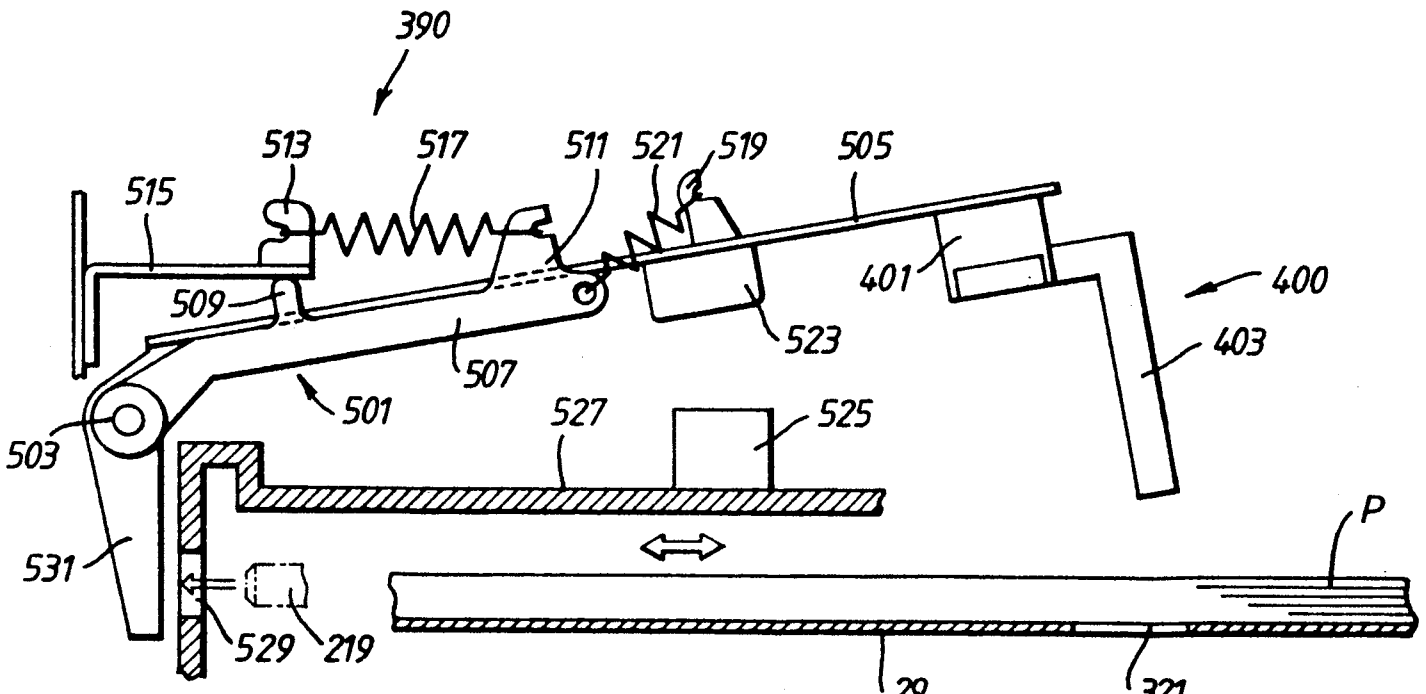
FIG. 10 is a sectional view of the principle part of a mechanism for moving the free arm of the detecting device shown in FIG. 6.

Referring now to FIG. 10, moving unit 390 includes a rotating arm 501. Rotating arm 501 is L-shaped and is rotated around an axis 503. A lever 505 is also rotatable around axis 503. Detecting device 400 is fixed to the end of lever 505.

A horizontal portion 507 of rotating arm 501 has a first projection 509 and a first hook 511. First hook 511 is connected to a second hook 513 on a bracket 515 with a first spring 517. Bracket 515 is fixed mechanically to a body of copying machine 11.

Lever 505 has a third hood 519 which is connected to the point of horizontal portion 507 of rotating arm 501 with a second spring 521.

Through the actions of first and second springs 517 and 521, rotating arm 501 and lever 505 are caused to rotate counterclockwise until first projection 509 runs against bracket 515 and is caused to stop.

Lever 505 has a second projection 523, extending down. The down movement of lever 505 is limited by second projection 523 and third projection 525 provided on a base 527. Cassette 29 may be inserted into or removed from a base 527 of copying machine 11.

When cassette 29 is inserted into base 527, the side with pin 219 is the leading side. If cassette 29 is to be inserted into base 527, pin 219 is inserted into a detecting hole 529. Furthermore, pin 219 pushes a vertical portion 531 of rotating arm 501. Rotating arm 501 pushed by pin 219 is caused to rotate clockwise around axis 503 as shown in FIG. 10 against first spring 517. Then the point horizontal portion 507 is caused to go down so that the lever 505 is caused to rotate clockwise by rotating arm 501 through second spring 521. At the same time, detecting device 400 is caused to move downwardly. If there is a paper sheet P in cassette 29, cassette 29 is caused to stop by the paper sheet P in cassette 29. If there is no paper sheet P in cassette 29, the tip portion of free arm 403 drops into hole 321 on the bottom of cassette 29.

Figure 11:
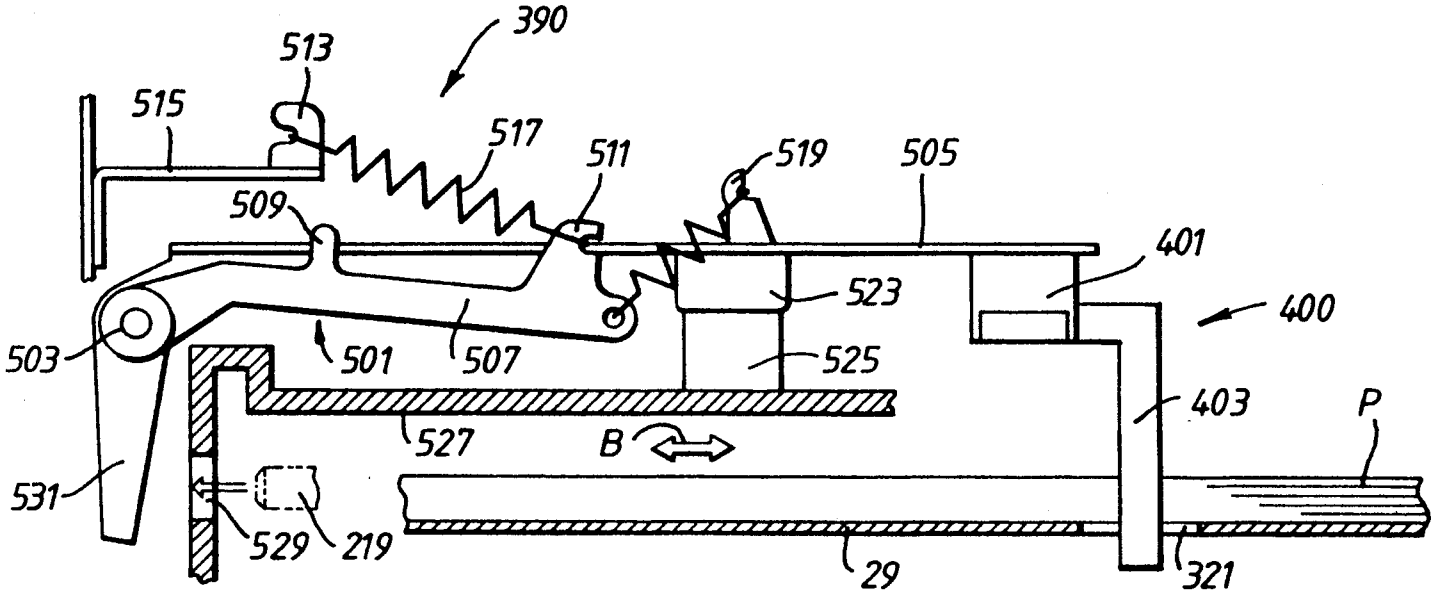
FIG. 11 is a sectional view showing the movement of the principle part shown in FIG. 10.

As seen FIG. 11, if pin 219 pushes vertical portion 531 of rotating arm 501 much more, rotating arm 501 is caused to rotate much more clockwise. This case will occur due to the mechanical precision of the elements in copying machine 11, e.g., cassette 29, pin 219 and base 527 and so on. In this case, horizontal portion 505 is caused to go down more so that lever 505 is caused to go down through second spring 521. Third projection 523 and fourth projection 525 fail to go down after third projection 523 abuts fourth projection 525. By first and second springs 517 and 521, third and forth projections 523 and 525, the movement of detecting device 400 is restricted within the predetermined area.

Figure 12:
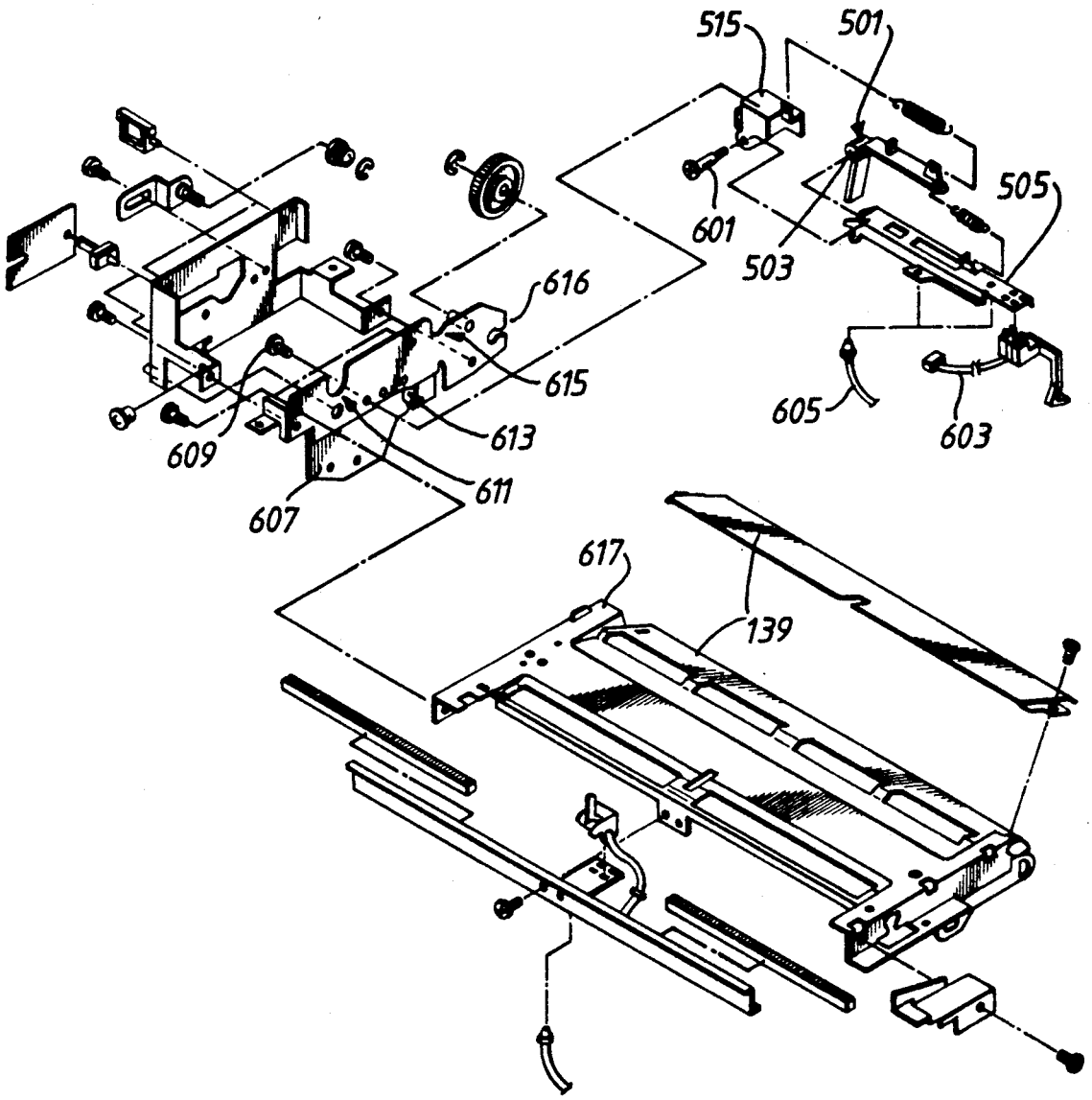
FIG. 12 is a explode perspective view of the detecting device shown in FIG. 6.

The detail of detecting device 400 is as follows:

Referring now to FIG. 12, screw 601 has a first portion with a thread and a second portion without a thread. Rotating arm 501 is fixed to bracket 515 through the thread of the first portion of screw 601. The edge of lever 505 is hooked-shaped and is hung at axis 503. The second portion of screw 601 makes rotating arm 501 and lever 505 rotate around axis 503. Detecting device 400 is fixed to the other edge of lever 505. The detected signal by detecting device 400 is outputted by a wire cable 603 which are fasten by a band 605.

Detecting device 400 is fixed to a feeding frame 607. That is, bracket 515 is fixed to feeding frame 607 through a screw 609. Feeding frame 607 has four portions 611, 613, 615 and 616. At portion 611 is deposited aligning roller 145. At cutting portion 613 is deposited feeding roller 151. At cutting portion 615 is deposited manual feed roller 141. At cutting portion 616 is deposited U-turn roller 155. A guide frame 617 including U-turn guide 159 is fixed to feeding frame 607.

Figure 13:
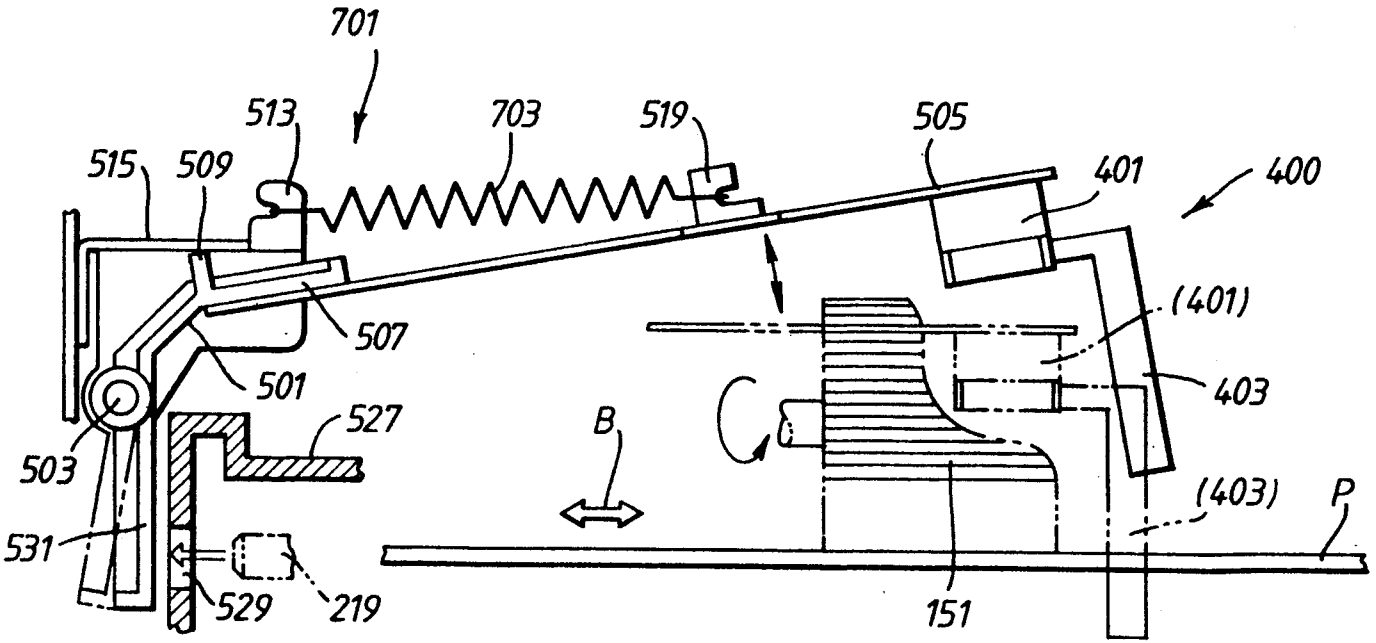
FIG. 13 is a sectional view showing a mechanism for moving the free arm shown in FIG. 6 according to another preferred embodiment of the present invention.

Referring now to FIG. 13, another embodiment of the present invention is as follows;

In the present embodiment a moving unit 701 is the simplified moving device shown in FIG. 10. Lever 595 is connected to rotating arm 501 so that both of rotating arm 501 and lever 505 are caused to move together. Without cassette 29 from the body of copying machine 11, lever 505 is deposited at a higher position by a spring 703 between second and third projection 513 and 519. As cassette 29 is inserted into the body, pin 219 pushes vertical portion 531 of rotating arm 501 to move down detecting device 400.

It will be recognized that there are other equivalent ways of moving detecting device 400. For example, it would be possible to move detecting device 400 by a leaf spring or solenoid.

It will be recognized that there are other equivalent ways how to detect the presence or the absence of the paper sheet in cassette. For example, it would by possible to detect the presence or the absence of the paper sheet in cassette by a magnetic change.

What is claimed is:

1. An apparatus for feeding sheet materials, the apparatus including a housing and a path defined in the housing into which is removably inserted a storing means for storing said plurality of sheet materials, the storing means being inserted in a first direction, the apparatus comprising:

means for feeding the sheet material along a second direction different from the first direction;

means for detecting the presence of the sheet material in the storing means; and means for moving the detecting means so that the detecting means is placed in a position removed from the path of movement of the storing means during insertion and removal of the storing means into and from the housing, without contact between the detecting means and the storing means.

2. The apparatus of claim 1, wherein the detecting means includes a tip portion having a bent end portion to form an acute angle against the top surface of the sheet material, which tip portion is movable along the first direction from a first position at which the tip portion abuts on the sheet material to a second position at which the tip portion is away from the sheet material, and a detecting device for detecting the position of the tip portion.

3. An apparatus for feeding sheet materials, the apparatus including a housing and a path defined in the housing into which is removably inserted a storing means, for storing said plurality of sheet materials, the storing means being inserted in a first direction, the apparatus comprising:

means for feeding the sheet materials along a second direction different from the first direction;

means for detecting the presence of sheet material in the storing means; and means for moving the detecting means so that the detecting means is placed in a position removed from the path of movement of the storing means during insertion and removal of the storing means into and from the housing, without contact between the detecting means and the storing means, the moving means including an arm rotating around an axis and having a horizontal portion to which the detecting means is fixed and a vertical portion which is pushed by the storing means when the storing means is inserted into the housing.

4. The apparatus of claim 3, wherein moving means includes a first spring to pull up the horizontal portion.

5. The apparatus of claim 4, wherein the rotating arm includes a lever to which the detecting means is fixed and a second spring connecting the lever to the rotating arm, and the lever is rotatable independently of the rotating arm, the moving means including means for limiting the movement of the detecting means.

6. The apparatus of claim 3, wherein the storing means includes pushing means for pushing the vertical portion of the rotating arm when the storing means is inserted into the housing.

7. An image forming apparatus for forming a visible image on a sheet material, comprising:

a housing defining a path therein;

means removably inserted in the path of the housing along a first direction for storing a plurality of sheet materials;

means for feeding the sheet materials along a second direction different from the first direction;

means for forming visible images on the fed sheet materials;

means for detecting the presence of sheet material in the storing means; and means for moving the detecting means so that the detecting means is placed in a position removed from the path of movement of the storing means during insertion and removal of the storing means into and from the housing, without contact between the detecting means and the storing means.

8. The apparatus of claim 7, wherein the detecting means includes a tip portion having a bent end portion to form an acute angle against the surface of the sheet material, which end portion is movable along the first direction from a first position at which the tip portion abuts on the sheet material to a second position at which the tip portion is away from the sheet material, and a detecting device for detecting the position of the tip portion.

9. An image forming apparatus for forming visible images on sheet materials, comprising;

a housing defining a path therein;

means, removably inserted in the path of the housing along a first direction, for storing a plurality of sheet materials;

means for feeding the sheet material along a second direction different from the first direction;

means for forming visible images on the fed sheet material;

means for detecting the presence of sheet material in the storing means; and means for moving the detecting means so that the detecting means is placed in a position removed from the path of movement of the storing means during insertion and removal of the storing means into and from the housing, without contact between the detecting means and the storing means, the moving means including a rotating arm having a horizontal portion to which the detecting means is fixed and a vertical portion which is pushed by the storing means when the storing means is inserted into the housing.

10. The apparatus of claim 9, wherein the first moving means includes a first spring to pull up the horizontal portion of the rotating arm.

11. The apparatus of claim 10, wherein the rotating arm further comprises a lever to which the detecting means is fixed and a second spring connecting the lever to the rotating arm, the lever being rotatable independently of the rotating arm, the moving means including means for limiting the movement of the moving means.

12. The apparatus of claim 9, wherein the storing means includes pushing means for pushing the the vertical portion of the rotating arm when the storing means is inserted into the housing.

* * * * *